US011387607B2

(12) United States Patent
Guo

(10) Patent No.: US 11,387,607 B2
(45) Date of Patent: Jul. 12, 2022

(54) ELECTRICAL CONNECTOR ASSEMBLY AND INTERCONNECT DEVICE

(71) Applicant: Dongguan Luxshare Technologies Co., Ltd, Dongguan (CN)

(72) Inventor: Rong-Zhe Guo, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 5 days.

(21) Appl. No.: 17/195,090

(22) Filed: Mar. 8, 2021

(65) Prior Publication Data

US 2021/0194183 A1 Jun. 24, 2021

(30) Foreign Application Priority Data

Apr. 15, 2020 (CN) ..... 202010295864.6

(51) Int. Cl.

| | |
|---|---|
| ***H01R 4/66*** | (2006.01) |
| ***H01R 13/6471*** | (2011.01) |
| ***H01R 12/71*** | (2011.01) |
| ***H01R 13/24*** | (2006.01) |
| ***H01R 13/516*** | (2006.01) |
| ***H01R 13/6587*** | (2011.01) |

(Continued)

(52) U.S. Cl.

CPC ..... *H01R 13/6471* (2013.01); *H01R 12/714* (2013.01); *H01R 13/2407* (2013.01); *H01R 13/516* (2013.01); *H01R 13/6587* (2013.01); *H01R 13/6599* (2013.01); *H01R 43/20* (2013.01)

(58) Field of Classification Search

CPC .. H01R 12/712; H01R 12/714; H01R 12/718; H01R 13/6471; H01R 13/2407; H01R 13/516; H01R 13/6587; H01R 13/6599; H01R 43/20

USPC ..... 439/55–85, 108

See application file for complete search history.

(56) References Cited

U.S. PATENT DOCUMENTS

| | | | |
|---|---|---|---|
| 7,223,105 | B2 | 5/2007 | Weiss et al. |
| 8,926,343 | B2 | 1/2015 | Mason et al. |
| 9,705,242 | B1 | 7/2017 | Hsiskanen et al. |

(Continued)

FOREIGN PATENT DOCUMENTS

| | | |
|---|---|---|
| CN | 101997190 A | 3/2011 |
| CN | 103490229 A | 1/2014 |

(Continued)

*Primary Examiner* — Khiem M Nguyen

(74) *Attorney, Agent, or Firm* — Birch, Stewart, Kolasch & Birch, LLP

(57) ABSTRACT

An electrical connector assembly includes a plurality of signal terminals, a plurality of grounding terminals, and an elastic conductor. Each of the signal terminals corresponds to a first signal bump. Each of the grounding terminals is adjacent to the signal terminal and corresponds to a first grounding bump. The elastic conductor has a plurality of elastic conducting portions and is disposed on a carrier. An interconnect device is also provided. The interconnect device includes the electrical connector assembly, the carrier, and a chip. The signal terminals and the grounding terminals of the electrical connector are electrically connected to the first signal bumps and the first grounding bumps of the carrier through compressing the elastic conducting portions of the elastic conductor.

14 Claims, 7 Drawing Sheets

(51) Int. Cl.
*H01R 13/6599* (2011.01)
*H01R 43/20* (2006.01)

(56) References Cited

U.S. PATENT DOCUMENTS

| | | | | |
|---|---|---|---|---|
| 9,843,135 | B2 | 12/2017 | Guetig et al. | |
| 10,348,040 | B2 | 7/2019 | Cartier, Jr. et al. | |
| 2021/0194183 | A1* | 6/2021 | Guo | H01R 13/6599 |

FOREIGN PATENT DOCUMENTS

| | | | |
|---|---|---|---|
| CN | 105531875 | A | 4/2016 |
| CN | 107863655 | A | 3/2018 |
| TW | I380026 | B1 | 12/2012 |
| TW | M572584 | U | 1/2019 |
| TW | 201932847 | A | 8/2019 |

* cited by examiner

ELECTRICAL CONNECTOR ASSEMBLY AND INTERCONNECT DEVICE

CROSS-REFERENCE TO RELATED APPLICATION

This non-provisional application claims priority under 35 U.S.C. § 119(a) to Patent Application No. 202010295864.6 filed in China, P.R.C. on Apr. 15, 2020, the entire contents of which are hereby incorporated by reference.

BACKGROUND

Technical Field

The instant disclosure relates to an electrical connector assembly, and more particular to an electrical connector assembly having an elastic conductor and an interconnect device.

Related Art

A common contact of the connectors known to the inventor(s) is implemented by allowing upper and lower rows of metal terminals being in contact with each other through the normal force between the upper and lower rows of metal terminals. As far as the contact is concerned, the metal terminals belong to the elastic contact structure, so that the normal force affects the impedance of the metal terminal. Therefore, a sufficiently low contact impedance is to be maintained between the terminals to avoid the disconnection caused by vibration or other external forces in the use of the connectors.

In terms of structural improvement, an eye-of-the-needle (EON) terminal has been designed. With the elastic restoring force, each of the terminals is in close contact with a corresponding insertion hole and ensures electrical connections between the terminals and the main circuit board. However, due to the structure of the eye-of-the-needle terminals, the connector cannot be easily removed from the main circuit board.

SUMMARY

In view of this, an embodiment of the instant disclosure provides an electrical connector assembly. The electrical connector assembly is capable of being assembled on a carrier, and a plurality of first signal bumps and a plurality of first grounding bumps are disposed on the carrier. The electrical connector assembly comprises a plurality of signal terminals, a plurality of grounding terminals, and an elastic conductor. The signal terminals are capable of being corresponding to the first signal bumps. The grounding terminals are disposed adjacent to the signal terminals and capable of being corresponding to the first grounding bumps. The elastic conductor has a plurality of elastic conductive portions. The elastic conductor is capable of being disposed above the carrier, and the signal terminals and the grounding terminals compress the elastic conductive portions of the elastic conductor, so that the signal terminals and the grounding terminals are capable of being electrically connected to the first signal bumps and the first grounding bumps of the carrier.

In some embodiments, the signal terminals are directly abutted against the elastic conductor, so that the signal terminals are capable of being electrically connected to the first signal bumps. The grounding terminals are directly abutted against the elastic conductor, so that the grounding terminals are capable of being electrically connected to the first grounding bumps.

In some embodiments, the electrical connector assembly further comprises a connector circuit board. The connector circuit board is disposed between the signal terminals and the elastic conductor and disposed between the grounding terminals and the elastic conductor. The connector circuit board comprises a plurality of signal channels and a plurality of grounding channels, and a plurality of second signal bumps and a plurality of second grounding bumps are disposed on a bottom of the connector circuit board. The signal terminals pass through and are electrically connected to the signal channels on the connector circuit board, and the second signal bumps compress and are electrically connected to the elastic conductor. The grounding terminals pass through and are electrically connected to the grounding channels on the connector circuit board, and the second grounding bumps compress and are electrically connected to the elastic conductor.

In some embodiments, the carrier is a circuit board.

In some embodiments, the electrical connector assembly further comprises an insulated body and a plurality of cables. The insulated body comprises a plurality of through holes, and the cables pass through the through holes from one of two ends of the insulated body. Two of the signal terminals are connected to an end portion of one of the cables, and the two of the signal terminals pass out of the insulated body from the other end of the two ends of the insulated body.

In some embodiments, each of the signal terminals has a first fisheye, and each of the grounding terminals has a second fisheye. The first fisheye of each of the signal terminals is perpendicular to the second fisheye of each of the grounding terminals.

In some embodiments, each of the cables comprises an insulation layer, a plastic layer, and a shielding layer. The insulation layer respectively encloses the two of the signal terminals, the plastic layer encloses the insulation layer, and the shielding layer encloses the plastic layer.

In some embodiments, the electrical connector assembly further comprises a plurality of metal spacers disposed in the insulated body. Each two of the grounding terminals are combined as a terminal set and adjacent to each other, each of the terminal sets is perpendicular to the metal spacers, and the terminal sets are disposed on the metal spacers at intervals, so that a plurality of spaces is divided by the terminal sets and the metal spacers; each of the cables passes through each of the spaces.

In some embodiments, the insulated body comprises a plurality of insulating frames arranged parallel to each other. Each of the insulating frames is fixed with the signal terminals, the grounding terminals, and the cables.

In some embodiments, each of the insulating frames is enclosed by a plurality of conductive shells. The conductive shells are connected to the grounding terminals.

In some embodiments, a conductive plate is disposed between the conductive shells adjacent to the insulating frames. A plurality of elastic pieces bilaterally extends from side portions of the conductive plates, and the elastic pieces are abutted against the conductive shells.

In some embodiments, a plurality of convex sheets extends from bottoms of the conductive shells toward the carrier. Each of the convex sheets is adjacent to a corresponding pair of the signal terminals.

Another embodiment of the instant disclosure provides an interconnect device. The interconnect device comprises the electrical connector assembly, a carrier, and a chip. The chip is assembled on and electrically connected to the carrier.

In some embodiments, the carrier is a circuit board. The electrical connector assembly is assembled on the carrier and electrically connected to the chip through the carrier.

In the electrical connector assembly and the interconnect device provided by one or some embodiments of the instant disclosure, with the configuration of the elastic conductor, when the elastic conductor is compressed at the contact between the connector and the main circuit board, the electrical connection between the connector and the main circuit board can be achieved. Moreover, with the configuration of the elastic conductor, the connector can be easily removed from the main circuit board, thereby meeting flexible users' needs.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
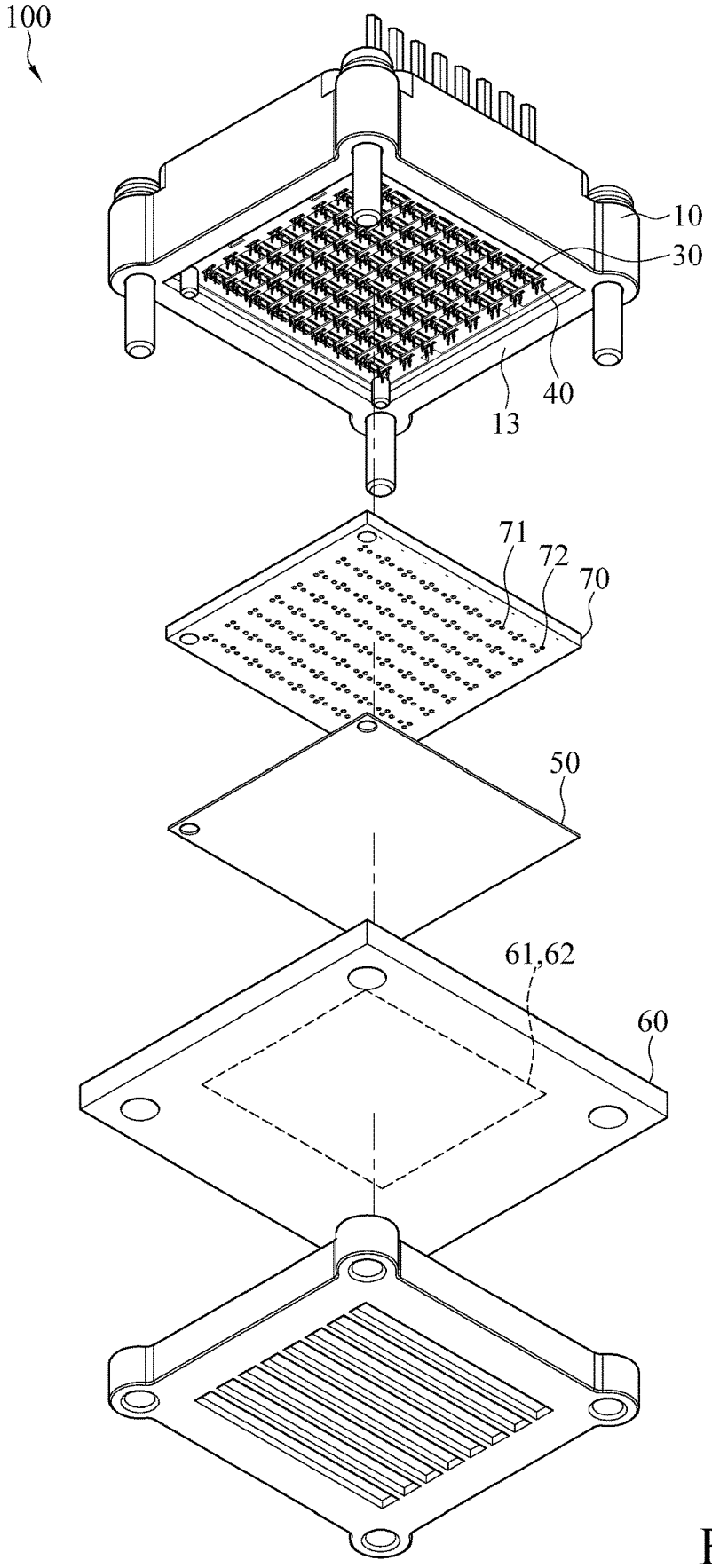
FIG. 1 illustrates an exploded view of an electrical connector assembly according to an exemplary embodiment of the instant disclosure.
Figure 2:
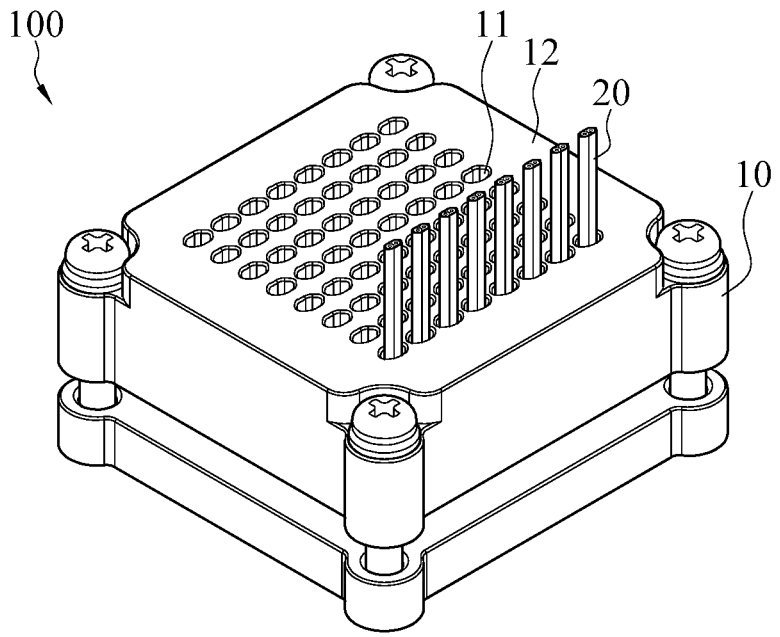
FIG. 2 illustrates a perspective view of the electrical connector assembly of the exemplary embodiment.

Please refer to FIGS. 1 and 2, an electrical connector assembly according to an exemplary embodiment of this disclosure is illustrated. FIG. 1 illustrates an exploded view of the electrical connector assembly. FIG. 2 illustrates a perspective view of the electrical connector assembly. As shown in FIG. 1, the electrical connector assembly 100 comprises a plurality of signal terminals 30, a plurality of grounding terminals 40, and an elastic conductor 50. In this embodiment, the electrical connector assembly 100 is capable of being assembled on a carrier 60. For example, the carrier 60 may be a circuit board, and a plurality of first signal bumps 61 and a plurality of first grounding bumps 62 are disposed on the circuit board.

During assembly, the signal terminals 30 of the electrical connector assembly 100 correspond to the first signal bumps 61, while the grounding terminals 40 are disposed adjacent to the signal terminals 30 and correspond to the first grounding bumps 62.

Please keep referring to FIG. 1, in this embodiment, the elastic conductor 50 is capable of being disposed above the carrier 60. When the signal terminals 30 and the grounding terminals 40 are to be electrically connected to the first signal bumps 61 and the first grounding bumps 62 of the carrier 60, the signal terminals 30 and the grounding terminals 40 can be electrically connected to the first signal bumps 61 and the first grounding bumps 62 of the carrier 60 by directly or indirectly contacting the elastic conductor 50 to compress the elastic conductor 50, respectively.

In one embodiment, the signal terminals 30 are directly abutted against the elastic conductor 50, so that the signal terminals 30 are capable of being electrically connected to the first signal bumps 61. The grounding terminals 40 are directly abutted against the elastic conductor 50, so that the grounding terminals 40 are capable of being electrically connected to the first grounding bumps 62.

In this embodiment, the signal terminals 30 and the grounding terminals 40 are electrically connected to the first signal bumps 61 and the first grounding bumps 62 of the carrier 60, respectively, by indirect contact and compression of the elastic conductor 50. As shown in FIG. 1, the electrical connector assembly 100 further comprises a connector circuit board 70. The connector circuit board 70 is disposed between the signal terminals 30 and the elastic conductor 50 and disposed between the grounding terminals 40 and the elastic conductor 50. The connector circuit board 70 comprises a plurality of signal channels and a plurality of grounding channels (not shown in the FIG. 1), and a plurality of second signal bumps 71 and a plurality of second grounding bumps 72 are disposed on a bottom of the connector circuit board 70. The second signal bumps 71 are disposed between the signal channels and the elastic conductor 50, and the second grounding bumps 72 are disposed between the grounding channels and the elastic conductor 50. The signal terminals 30 pass through and are electrically connected to the connector circuit board 70 via the metal of the signal channels, and the second signal bumps 71 compress and are electrically connected to the elastic conductor 50. The grounding terminals 40 pass through and are electrically connected to the connector circuit board 70 via the metal of the grounding channels, and the second grounding bumps 72 compress and are electrically connected to the elastic conductor 50.

With the configuration of the elastic conductor 50, when the elastic conductor 50 is compressed at the contact between the signal terminals 30, the grounding terminals 40, and the carrier 60 (such as a circuit board), the electrical connection among the signal terminals 30, the grounding terminals 40, and the carrier 60 can be achieved. Furthermore, with the configuration of the elastic conductor 50, the signal terminals 30 and the grounding terminals 40 can be easily removed from the carrier 60 (such as the circuit board), thereby meeting flexible users' needs.

As shown in FIG. 1, in this embodiment, the first signal bumps 61, the first grounding bumps 62, the second signal bumps 71, and the second grounding bumps 72 are exemplified by pads on the circuit board, but embodiments are not limited thereto. In some embodiments, the first signal bumps 61, the first grounding bumps 62, the second signal bumps 71, and the second grounding bumps 72 may be ball grid arrays (BGA) that are additionally provided on the circuit board.

Please refer to FIGS. 1 and 2, the electrical connector assembly 100 further comprises an insulated body 10 and a plurality of cables 20. The insulated body 10 comprises a plurality of through holes 11. The cables 20 pass through the through holes 11 from one of two ends 12 of the insulated body 10, and the signal terminals 30 and the grounding terminals 40 pass out of the insulated body 10 from the other end of the two ends 13 of the insulated body 10.

Figure 3:
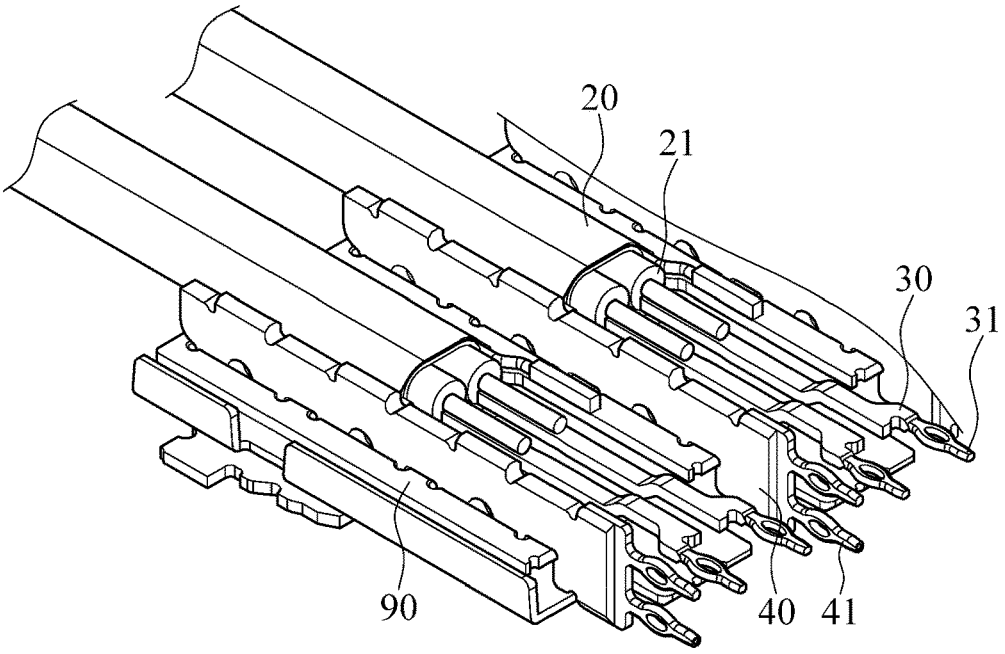
FIG. 3 illustrates a partial perspective view of a plurality of signal terminals and a plurality of grounding terminals of the electrical connector assembly of the exemplary embodiment.

In order to illustrate and explain the connection arrangement between the cables 20 and the signal terminals 30 more clearly, and to illustrate the relative positional relationship between the signal terminals 30 and the grounding terminals 40 at the front end fisheye structure, please refer to FIG. 3. FIG. 3 illustrates a partial perspective view of a plurality of signal terminals and a plurality of grounding terminals of the electrical connector assembly. For convenience of explanation, portions of the external structures of the cables 20 have been omitted. As shown in FIG. 3, two of the signal terminals 30 are connected to an end portion 21 of the cable 20. Each of the signal terminals 30 has a first fisheye 31, and each of the grounding terminals 40 has a second fisheye 41. The first fisheye 31 of each of the signal terminals 30 is perpendicular to the second fisheye 41 of each of the grounding terminals 40, thereby the first fisheye 31 and the second fisheye 41 guiding the installation direction, so that the electrical connector assembly 100 can be accurately crimped onto the connector circuit board.

In this embodiment, through the fisheye structures, the signal terminals 30 and the grounding terminals 40 are compressed and electrically connected to the elastic conductor 50, but embodiments are not limited thereto. In some embodiments, the signal terminals 30 and the grounding terminals 40 may have other compressible configurations to compress and electrically connected to the elastic conductor 50.

Furthermore, as shown in FIG. 3, in this embodiment, the electrical connector assembly 100 further comprises a plurality of metal spacers 90 disposed in the insulated body 10. Each two of the grounding terminals 40 are combined as a terminal set and adjacent to each other. Each of the terminal sets is perpendicular to the metal spacers 90, and the terminal sets are disposed on the metal spacers 90 at intervals, so that a plurality of spaces is divided by the terminal sets and the metal spacers 90. Each of the cables 20 passes through each of the spaces, and the grounding wires of the cable 20 are connected to the metal spacers 90.

Figure 4:
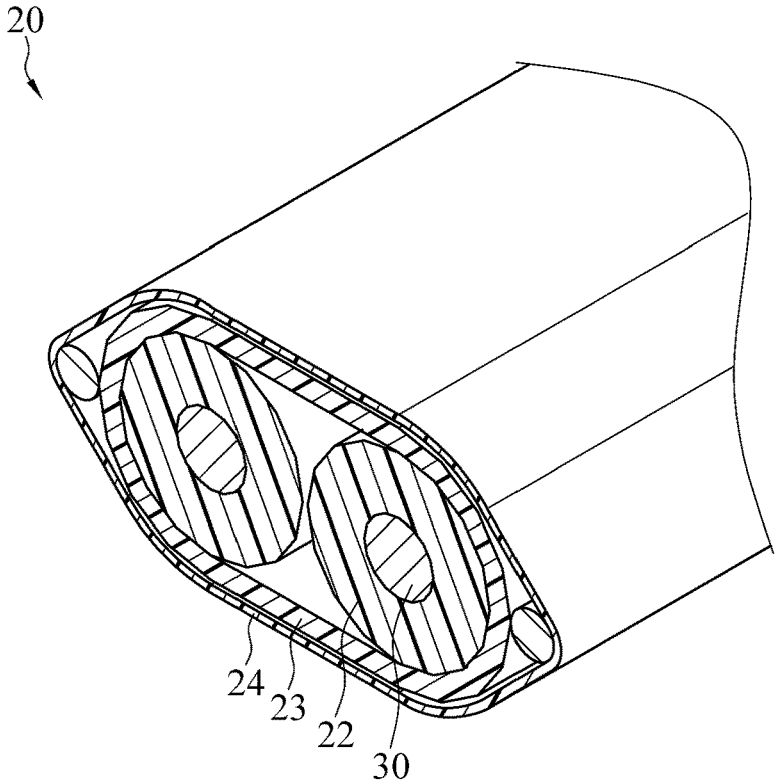
FIG. 4 illustrates a partial cross-sectional view of a cable of the electrical connector assembly of the exemplary embodiment.

Please refer to FIG. 4. FIG. 4 illustrates a partial cross-sectional view of a cable of the electrical connector assembly. As shown in FIG. 4, each of the cables 20 comprises an insulation layer 22, a plastic layer 23, and a shielding layer 24. The insulation layer 22 respectively encloses the two of the signal terminals 30, the plastic layer 23 encloses the insulation layer 22, and the shielding layer 24 encloses the plastic layer 23.

Figure 5:
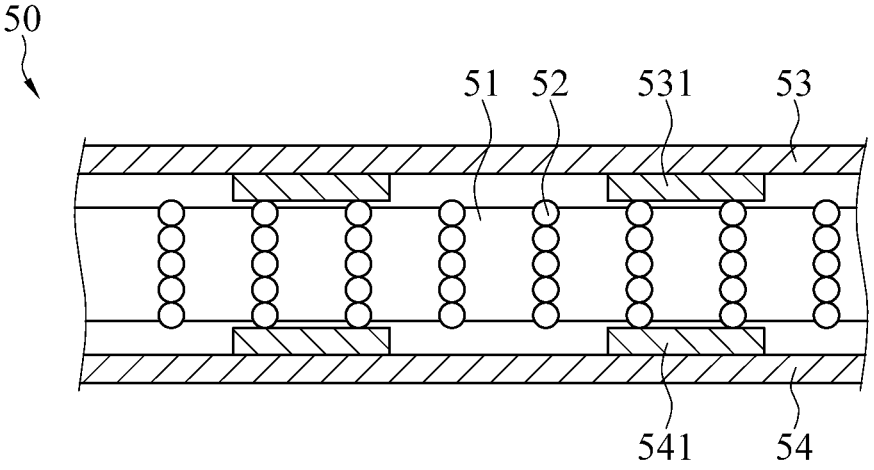
FIG. 5 illustrates a schematic cross-sectional view showing a plurality of conductive particles of an elastic conductor of the electrical connector assembly of the exemplary embodiment in which the conductive particles are not compressed yet.
Figure 6:
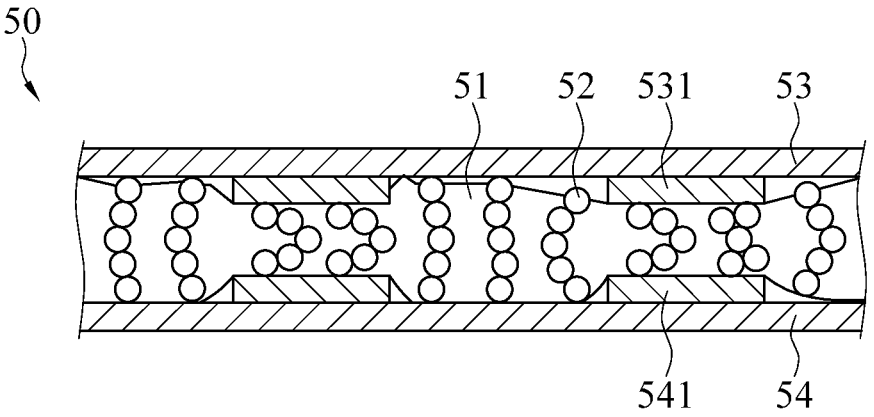
FIG. 6 illustrates a schematic cross-sectional view showing the conductive particles of the elastic conductor of the electrical connector assembly of the exemplary embodiment in which the conductive particles are compressed.

Next, please refer to FIGS. 5 and 6. FIG. 5 illustrates a schematic cross-sectional view showing a plurality of conductive particles of an elastic conductor of the electrical connector assembly of the exemplary embodiment in which the conductive particles are not compressed yet. FIG. 6 illustrates a schematic cross-sectional view showing the conductive particles of the elastic conductor of the electrical connector assembly of the exemplary embodiment in which the conductive particles are compressed. In this embodiment, the elastic conductor 50 has a plurality of elastic conductive portions 51, an upper circuit board 53, and a lower circuit board 54. The upper circuit board 53 has a plurality of second bumps 531, and the lower circuit board 54 has a plurality of first bumps 541. Specifically, in this embodiment the conductive particles in each of the elastic conductive portions 51 are arranged in the compression direction, and do not contact the conductive particles of the adjacent elastic conductive portion. As shown in FIGS. 5 and 6, the conductive particles 52 in the compression direction in FIG. 6 are denser than the conductive particles 52 in FIG. 5. Therefore, the elastic conductor 50 in the compressed state (as indicated by FIG. 6) has a better conductive efficiency as compared with the elastic conductor in the uncompressed state (as indicated by FIG. 5).

Figure 7:
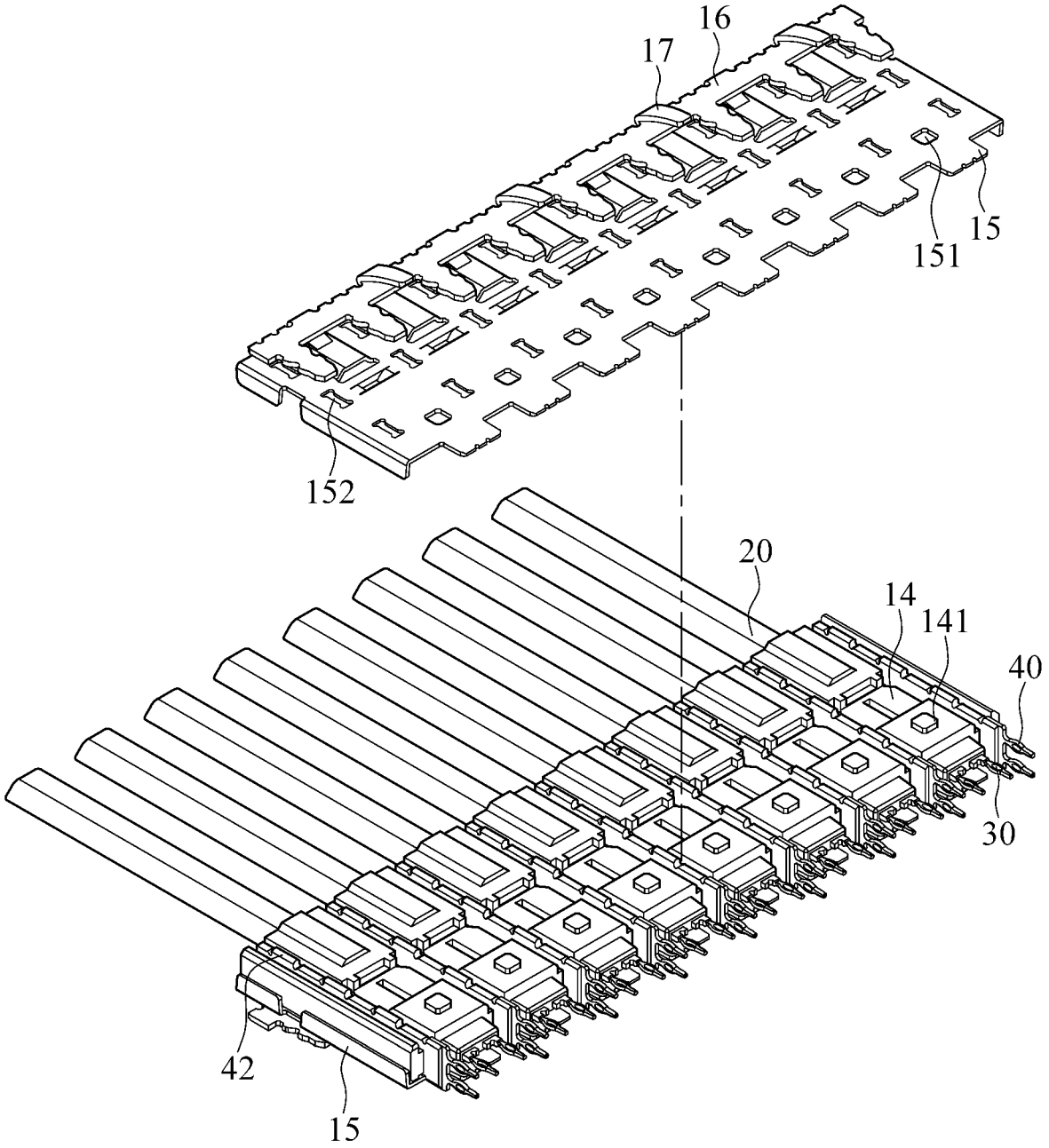
FIG. 7 illustrates an exploded view (I) of an internal structure of an insulated body of the electrical connector assembly of the exemplary embodiment.
Figure 8:
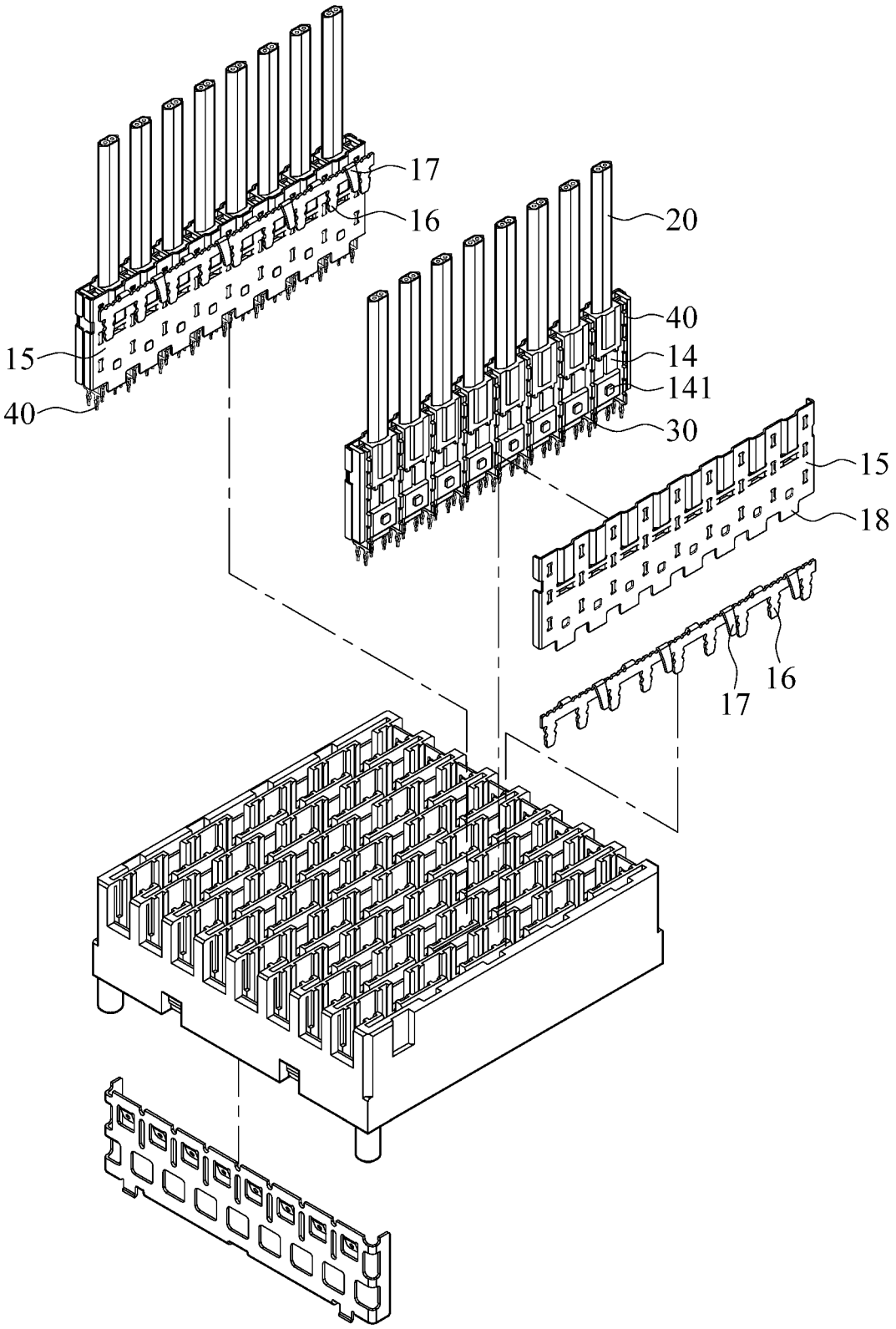
FIG. 8 illustrates an exploded view (II) of the internal structure of the insulated body of the electrical connector assembly of the exemplary embodiment.

In order to illustrate and explain the internal structure of the insulated body 10 more clearly, please refer to FIGS. 7 and 8. FIG. 7 illustrates an exploded view (I) of the internal structure of an insulated body of the electrical connector assembly. FIG. 8 illustrates an exploded view (II) of the internal structure of the insulated body of the electrical connector assembly. For convenience of explanation, one row of the cables 20 and some components are illustrated in FIG. 7 with the outer shell body of the insulated body 10 omitted. As shown in FIG. 7, the insulated body 10 comprises a plurality of insulating frames 14, and each of the insulating frames 14 is fixed with the signal terminals 30, the grounding terminals 40, and the cables 20. Each of the insulating frames 14 is enclosed by a plurality of conductive shells 15, and the conductive shells 15 are connected to the grounding terminals 40. When the grounding terminals 40 are fixed on both sides of the cables 20, the grounding terminals 40 are arranged perpendicular to each other. Each of the grounding terminals 40 comprises a side plate 42, and the side plates 42 are perpendicular to the metal spacers 90. Each of the cables 20 is disposed between two adjacent side plates 42. A plurality of the second fisheyes 41 is protruding out of the side plates 42 of the grounding terminals 40, and a plurality of through holes 152 is disposed on the conductive shells 15 correspondingly. During assembly, the side plates 42 of the grounding terminals 40 are accommodated in the through holes 152 of the conductive shells 15 to be fixed with the conductive shells 15.

Furthermore, the conductive shells 15 comprise a plurality of through holes 151, and a plurality of bumps 141 is disposed on the insulating frames 14 correspondingly. Hence, after the grounding terminals 40 are perpendicular to the metal spacers 90 and the cables 20 pass through the spaces 20, by the corresponding buckling between the bumps 141 and the through holes 151, the conductive shells 15, the insulating frames 14, and the cables 20 can be fixed and assembled in the internal structure of the insulated body 10. The insulating frames 14 may be plural and arranged in parallel with each other. In each of the insulating frames 14, a plurality of the signal terminals 30, a plurality of the grounding terminals 40, and a plurality of the cables 20 are fixed with the insulating frame 14 and are assembled with the metal spaces 90 to form a horizontal row component.

As shown in FIG. 8, a conductive plate 16 is disposed between the conductive shells 15 of the adjacent insulating frames 14. A plurality of elastic pieces 17 bilaterally extends from side portions of the conductive plates 16. The elastic pieces 17 are abutted against the conductive shells 15. A plurality of convex sheets 18 extends from bottoms of the conductive shells 15 toward the carrier 60, and each of the convex sheets 18 is adjacent to a corresponding pair of the signal terminals 30.

According to another embodiment of the instant disclosure, an interconnect device 200 is provided. The interconnect device 200 comprises the aforementioned electrical connector assembly 100, a carrier 60, and a chip 80.

Figure 9:
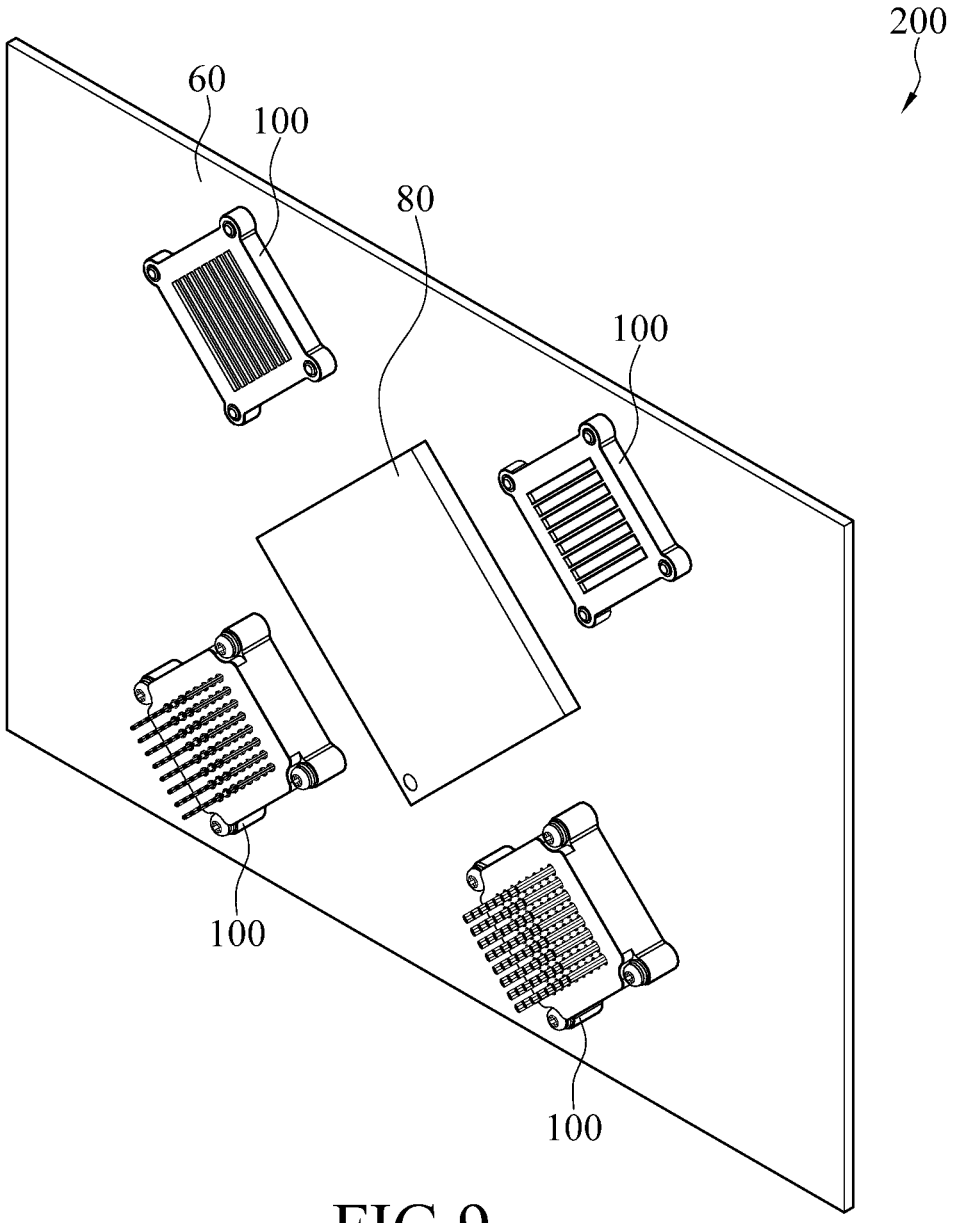
FIG. 9 illustrates a perspective view of an interconnect device according to an exemplary embodiment of the instant disclosure.

Please refer to FIG. 9. FIG. 9 illustrates a perspective view of an interconnect device according to an exemplary embodiment of the instant disclosure. The chip 80 is assembled on and electrically connected to the carrier 60. The carrier 60 is a circuit board, and the electrical connector assembly 100 is assembled on the carrier 60 and electrically connected to the chip 80 through the carrier 60. The interconnect device 200 according to one or some embodiments of the instant disclosure can achieve the electrical connection between the electrical connector assembly 100 on the carrier 60 and the chip 80.

In the electrical connector assembly 100 and the interconnect device 200 provided by one or some embodiments of the instant disclosure, with the configuration of the elastic conductor 50, when the elastic conductor 50 is compressed at the contact between the connector and the main circuit board, the electrical connection between the connector and the main circuit board can be achieved. Moreover, with the configuration of the elastic conductor 50, the connector can be easily removed from the main circuit board, thereby meeting flexible users' needs.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector assembly capable of being assembled on a carrier, wherein a plurality of first signal bumps and a plurality of first grounding bumps are disposed on the carrier, and the electrical connector assembly comprises:

a plurality of signal terminals capable of being corresponding to the first signal bumps;

a plurality of grounding terminals disposed adjacent to the signal terminals and capable of being corresponding to the first grounding bumps; and an elastic conductor having a plurality of elastic conductive portions, wherein the elastic conductor is capable of being disposed above the carrier, and the signal terminals and the grounding terminals compress the elastic conductive portions of the elastic conductor, so that the signal terminals and the grounding terminals are capable of being electrically connected to the first signal bumps and the first grounding bumps of the carrier.

2. The electrical connector assembly according to claim 1, wherein the signal terminals are directly abutted against the elastic conductor, so that the signal terminals are capable of being electrically connected to the first signal bumps, and the grounding terminals are directly abutted against the elastic conductor, so that the grounding terminals are capable of being electrically connected to the first grounding bumps.

3. The electrical connector assembly according to claim 1, further comprising a connector circuit board, wherein the connector circuit board is disposed between the signal terminals and the elastic conductor and disposed between the grounding terminals and the elastic conductor, the connector circuit board comprises a plurality of signal channels and a plurality of grounding channels, and a plurality of second signal bumps and a plurality of second grounding bumps are disposed on a bottom of the connector circuit board; the signal terminals pass through and are electrically connected to the signal channels on the connector circuit board, and the second signal bumps compress and are electrically connected to the elastic conductor; the grounding terminals pass through and are electrically connected to the grounding channels on the connector circuit board, and the second grounding bumps compress and are electrically connected to the elastic conductor.

4. The electrical connector assembly according to claim 1, wherein the carrier is a circuit board.

5. The electrical connector assembly according to claim 1, further comprising an insulated body and a plurality of cables, wherein the insulated body comprises a plurality of through holes, the cables pass through the through holes from one of two ends of the insulated body, two of the signal terminals are connected to an end portion of one of the cables, and the two of the signal terminals pass out of the insulated body from the other end of the two ends of the insulated body.

6. The electrical connector assembly according to claim 1, wherein each of the signal terminals has a first fisheye, each of the grounding terminals has a second fisheye, and the first fisheye of each of the signal terminals is perpendicular to the second fisheye of each of the grounding terminals.

7. The electrical connector assembly according to claim 5, wherein each of the cables comprises an insulation layer, a plastic layer, and a shielding layer, the insulation layer respectively encloses the two of the signal terminals, the plastic layer encloses the insulation layer, and the shielding layer encloses the plastic layer.

8. The electrical connector assembly according to claim 5, further comprising a plurality of metal spacers disposed in the insulated body, wherein each two of the grounding terminals are combined as a terminal set and adjacent to each other, each of the terminal sets is perpendicular to the metal spacers, and the terminal sets are disposed on the metal spacers at intervals, so that a plurality of spaces is divided by the terminal sets and the metal spacers; each of the cables passes through each of the spaces.

9. The electrical connector assembly according to claim 5, wherein the insulated body comprises a plurality of insulating frames arranged parallel to each other, and each of the insulating frames is fixed with the signal terminals, the grounding terminals, and the cables.

10. The electrical connector assembly according to claim 9, wherein each of the insulating frames is enclosed by a plurality of conductive shells, and the conductive shells are connected to the grounding terminals.

11. The electrical connector assembly according to claim 10, wherein a conductive plate is disposed between the conductive shells adjacent to the insulating frames, a plurality of elastic pieces bilaterally extends from side portions of the conductive plates, and the elastic pieces are abutted against the conductive shells.

12. The electrical connector assembly according to claim 9, wherein a plurality of convex sheets extends from bottoms of the conductive shells toward the carrier, and each of the convex sheets is adjacent to a corresponding pair of the signal terminals.

13. An interconnect device, comprising:

the electrical connector assembly according to claim 1;

a carrier; and a chip assembled on and electrically connected to the carrier.

14. The interconnect device according to claim 13, wherein the carrier is a circuit board, and the electrical connector assembly is assembled on the carrier and electrically connected to the chip through the carrier.

* * * * *